US005781945A

United States Patent [19]

Scherer et al.

[11] Patent Number: 5,781,945

[45] Date of Patent: Jul. 21, 1998

[54] PORTABLE FOLDABLE BED RAIL

[75] Inventors: Craig S. Scherer, Wilmette; Michael C. Thuma, Desplaines; David Corbett Brown; Brian James Woodard, both of Chicago; Michael Scott Garner, Northbrook, all of Ill.

[73] Assignee: BRK Brands, Inc., Aurora, Ill.

[21] Appl. No.: 650,173

[22] Filed: May 20, 1996

[51] Int. Cl.[6] ..... A47C 21/08

[52] U.S. Cl. ..... 5/426; 5/425; 5/430; 403/102; 403/103; 403/106

[58] Field of Search ..... 5/426–430; 403/102, 403/103, 106

[56] References Cited

U.S. PATENT DOCUMENTS

| | | | |
|---|---|---|---|
| 229,834 | 7/1880 | McMann . | |
| D. 317,098 | 5/1991 | Shuler | D6/503 |
| 1,039,986 | 10/1912 | Merrit . | |
| 1,041,147 | 10/1912 | Murphy . | |
| 1,066,976 | 7/1913 | Atkinson . | |
| 1,135,523 | 4/1915 | Henderson . | |
| 1,739,337 | 12/1929 | Von Canon et al. . | |
| 1,915,774 | 6/1933 | Busch . | |
| 2,048,955 | 7/1936 | Showalter | 5/94 |
| 2,209,801 | 7/1940 | Valverde | 219/45 |
| 2,369,552 | 2/1945 | Ferran | 5/94 |
| 2,532,007 | 11/1950 | Biasell | 5/94 |
| 2,571,364 | 10/1951 | Hosking | 24/73 |
| 2,602,171 | 7/1952 | Good | 5/319 |
| 2,608,696 | 9/1952 | Le Roy | 5/100 |
| 2,611,909 | 9/1952 | Dillon et al. | 5/331 |
| 2,619,215 | 11/1952 | Guss | 197/102 |
| 2,666,217 | 1/1954 | Stuart | 5/331 |
| 2,703,413 | 3/1955 | Klebanoff | 5/94 |
| 2,720,878 | 10/1955 | Hickman | 128/80 |
| 2,763,014 | 9/1956 | Luger | 5/331 |
| 2,817,854 | 12/1957 | Pratt | 5/331 |
| 2,817,855 | 12/1957 | Pratt | 5/331 |
| 2,859,454 | 11/1958 | Beckwell | 5/331 |
| 2,871,490 | 2/1959 | Balonick | 5/331 |
| 2,904,799 | 9/1959 | Berlin | 5/331 |
| 2,929,078 | 3/1960 | Smith et al. | 5/331 |
| 2,952,855 | 9/1960 | Zuti | 5/317 |
| 2,979,738 | 4/1961 | Goldberg | 5/331 |
| 3,002,200 | 10/1961 | Murcott | 5/331 |
| 3,021,534 | 2/1962 | Hausted | 5/331 |
| 3,032,781 | 5/1962 | Constanti | 5/331 |
| 3,089,152 | 5/1963 | Murcott | 5/331 |
| 3,179,957 | 4/1965 | Norton | 5/331 |
| 3,234,570 | 2/1966 | Hutt | 5/331 |
| 3,248,744 | 5/1966 | Hutt | 5/331 |
| 3,290,701 | 12/1966 | Luff . | |
| 3,402,409 | 9/1968 | Kain | 5/331 |
| 3,482,810 | 12/1969 | Bailey | 248/311 |
| 3,602,929 | 9/1971 | Murcott et al. | 5/331 |
| 3,616,469 | 11/1971 | Injeski . | |
| 3,747,133 | 7/1973 | Hutt | 5/331 |
| 3,855,654 | 12/1974 | Pivacek | 5/331 |
| 3,971,083 | 7/1976 | Peterson | 5/331 |

(List continued on next page.)

*Primary Examiner*—Alexander Grosz
*Attorney, Agent, or Firm*—Rockey, Milnamow & Katz, Ltd.

[57] ABSTRACT

A portable, foldable bed rail adapted for use with an associated bed having a mattress thereon includes a rail member having first and second substantially identical, mirror image end rail portions and a central rail portion. The end rail portions are hingedly mounted to the central rail portion by respective rail hinge members having parallel axes of rotation. The end rail portions are foldable toward one another adjacent to the central rail portion for storage. The end rails each include a support member having a support leg. The support members are independently hingedly mounted to a respective one of the end rail portions by support hinges. The support hinges have parallel axes of rotation and are rotatable in a direction transverse to the rail hinge members. Each of the support hinge members is independently movable toward and away from its respective end rail portion. The support legs are movable between a first, folded position wherein said support legs fold inward, adjacent to the rail member, and a second, operative position wherein the support legs fold outwardly, and extend generally transverse to the rail.

29 Claims, 4 Drawing Sheets

U.S. PATENT DOCUMENTS

| | | | |
|---|---|---|---|
| 4,084,277 | 4/1978 | Conrad et al. | 5/331 |
| 4,103,376 | 8/1978 | Benoit et al. | 5/331 |
| 4,178,645 | 12/1979 | Cosme | 5/426 |
| 4,186,456 | 2/1980 | Huempfner | 5/428 |
| 4,214,327 | 7/1980 | Smith | 5/444 |
| 4,215,446 | 8/1980 | Mahoney | 5/425 |
| 4,431,154 | 2/1984 | Hamm | 248/215 |
| 4,483,028 | 11/1984 | Payne | 5/426 |
| 4,484,367 | 11/1984 | Jenkins | 5/425 |
| 4,672,703 | 6/1987 | Frazier | 5/503 |
| 4,724,559 | 2/1988 | Bly | 5/425 |
| 4,747,171 | 5/1988 | Einsele et al. | 5/425 |
| 4,783,864 | 11/1988 | Turner | 5/424 |
| 4,833,743 | 5/1989 | Howell | 5/426 |
| 5,038,430 | 8/1991 | Bly | 5/425 |
| 5,044,025 | 9/1991 | Hunsinger et al. | 5/424 |
| 5,175,897 | 1/1993 | Marra, Jr. | 5/425 |
| 5,191,663 | 3/1993 | Holder et al. | 5/424 |
| 5,365,623 | 11/1994 | Springer | 5/658 |
| 5,381,571 | 1/1995 | Gabhart | 5/430 |
| 5,437,067 | 8/1995 | Bernstein et al. | 5/426 |
| 5,577,277 | 11/1996 | Sundberg et al. | 5/425 |
| 5,596,776 | 1/1997 | Huang | 5/426 |
| 5,640,726 | 6/1997 | Fichner-Rathus | 5/426 |

FIG. 7
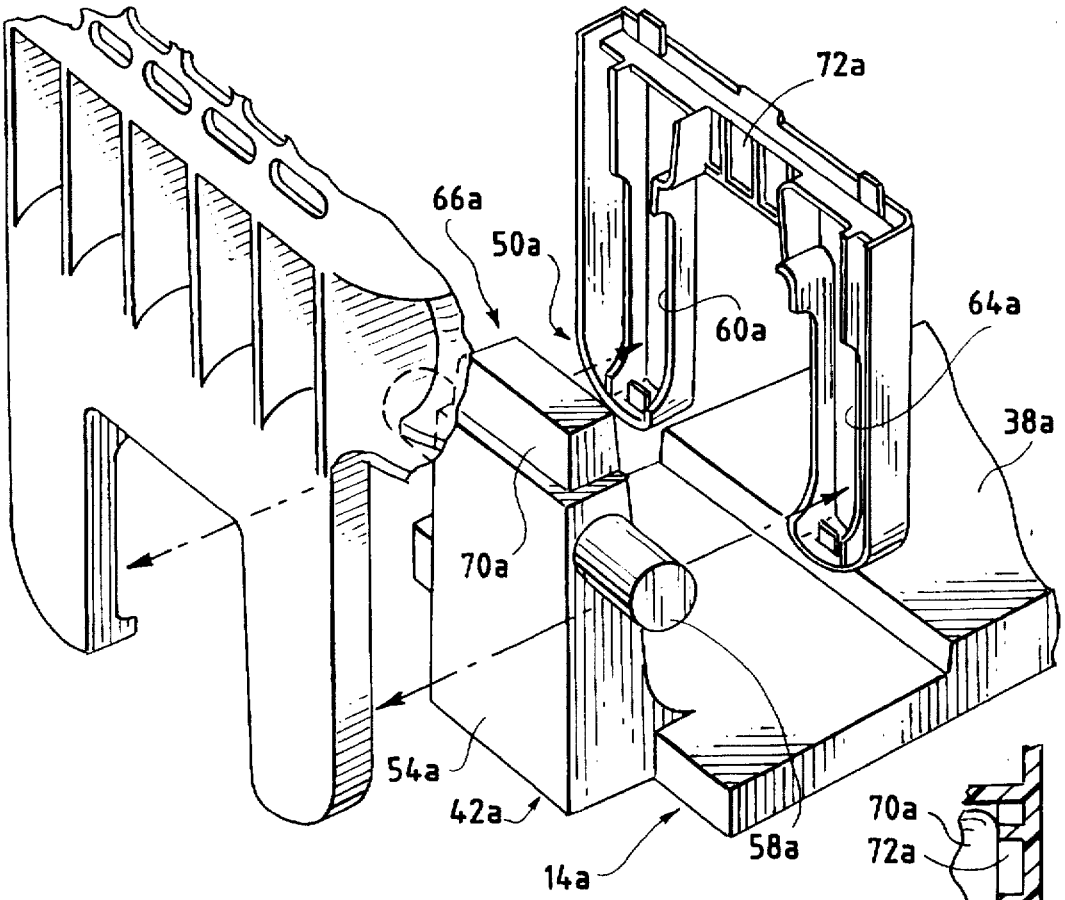
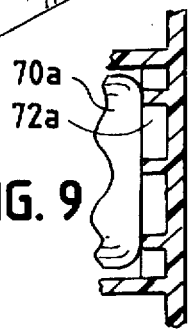
FIG. 9
FIG. 8
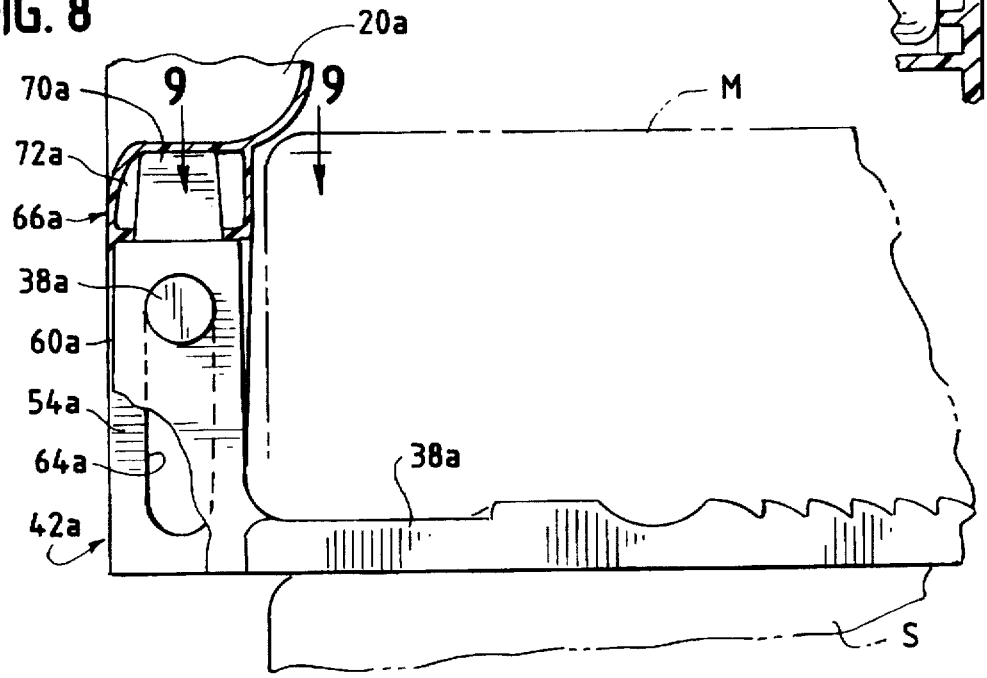

PORTABLE FOLDABLE BED RAIL

FIELD OF THE INVENTION

This invention pertains to bed rails. More particularly, the invention relates to portable, foldable bed rails which are readily erected, and which are foldable into a compact state for ease of storage.

BACKGROUND OF THE INVENTION

Bed rails have many uses. They are used, for example, for preventing young people, as well as infirm and older people from falling from a bed while they are resting or sleeping.

One known type of bed rail is permanently affixed to the bed, such as those commonly used with hospital beds. Such bed rails may be movable between an operative position, wherein the rail extends above the plane of the mattress and an inoperative position wherein the rail is lowered below the plane of the mattress. The inoperative position moves the rail out of the way and permits the individual or patient ready access to and from the bed.

Another known type of bed rail is portable, and generally includes legs or supports which are positioned between the mattress and the bed springs or box spring. A gate or rail extends generally transverse to the legs. The portable type of bed rail may be fixed, such that the rail must be completely removed for access to and from the bed. Alternately, this type of rail may be raised and lowered, or hinged, to provide access to and from the bed.

One drawback to the known portable bed rails, is that they may not be foldable for, for example, storage. As a result, such bed rails may require large amounts of space for storage. Often, particularly if the large amount of storage space required is not available underneath the bed or in a nearby closet, such bed rails may be placed in the open near the bed.

Accordingly, there continues to be a need for a portable, foldable bed rail, which can be folded in the length-wise direction (i.e., at various points along the length of the rail), and which includes supports which are foldable into the rail, for storage. Preferably, such a bed rail can be readily moved from an operative position to an inoperative position, while in place on the bed, to provide access to and from the bed.

SUMMARY OF THE INVENTION

A portable, foldable bed rail is adapted for use with an associated bed having a mattress thereon. The bed rail includes a foldable rail member and a pair of support members foldable adjacent to the rail member.

The rail member has first and second substantially identical, mirror image end rail portions and a central rail portion. Each of the end rail portions is hingedly mounted to the central rail portion by respective rail hinges. The rail hinges have parallel axes of rotation. The end rail portions are foldable toward one another, adjacent to the central rail portion.

The support members each have a support leg. Each of the support members is independently hingedly mounted to a respective one of the end rail portions by a support hinge member. The support hinge members have parallel axes of rotation and are rotatable in a direction transverse to the rail hinge members. Each of the support hinge members is independently movable toward and away from its respective end rail portion.

The support legs are movable between a first, folded position wherein the legs fold inward, adjacent to the rail member, and a second, operative position wherein the legs fold outwardly, extending generally transverse to the rail.

In one embodiment, the support hinges each include a locking portion which is adapted to lockingly engage the support members to their respective end rail portions when the support legs are in the transverse position. Preferably, the support hinges include a hinge post extending from each support member. The post has a pair of hinge pins extending therefrom. Each end rail portion defines a pair of slotted pin receptacles which are adapted to engage the hinge pins.

The support hinge is configured to permit movement of its respective support leg between the first, folded position and the second, operative position. The slotted pin receptacle is configured to permit sliding movement of the support member relative to the end rail portion to lockingly engage the support member with its respective end rail portion.

The hinge post may include a tenon-like projection extending therefrom which is adapted to engage a mortise-like opening formed in the support hinge. This configuration provides a locking engagement of the support member with its end rail portion when the support leg is in the operative position.

Other features and advantages of the present invention will be apparent from the following detailed description, the accompanying drawings, and the appended claims.

BRIEF DESCRIPTION OF THE FIGURES

FIG. 7 is a partial, exploded perspective view of the support hinge member, the illustrated parts being those as viewed from the right hand side of the orientation shown in FIG. 2;

FIG. 8 is a view in partial cross-section, and partially broken away of the support hinge member, the illustrated parts being those as viewed from the right hand side of the orientation shown in FIG. 2;

FIG. 9 is a partial cross-sectional view taken along line 9—9 of FIG. 8, the illustrated parts being those as viewed from the right hand side of the orientation shown in FIG. 2;

DETAILED DESCRIPTION OF THE PREFERRED EMBODIMENTS

Figure 1:
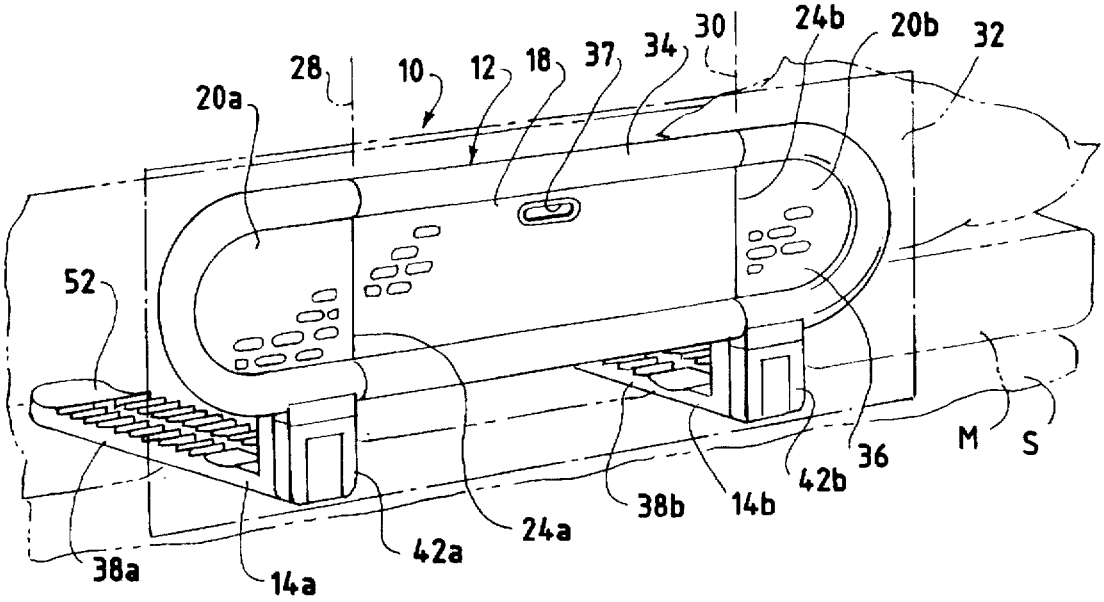
FIG. 1 is a perspective view of a portable, foldable bed rail embodying the principles of the present invention, the bed rail being illustrated with the rail in the operative position, in use with an associated bed, and having the support members positioned between the mattress and the box spring of the bed.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

With reference now to the figures, and particularly to FIG. 1, a portable, foldable bed rail 10 embodying the principles of the present invention is illustrated. The bed rail 10 includes a rail member 12 and pair of support members 14*a,b*. It is to be noted that the views of FIGS. 3–4 and 7–11, and the parts numerically identified therein are as viewed from the right hand side of FIG. 2, the left hand side being a mirror image thereof. Thus, for example, parts 20*a*, 24*a* and 38*a*, are mirror images of parts 20*b*, 24*b* and 38*b*, respectively.

Figure 5:
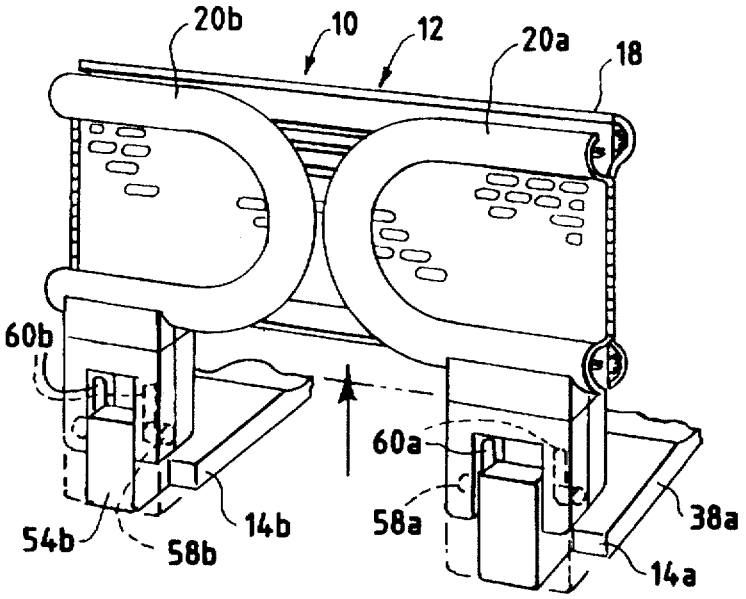
FIG. 5 is a perspective view of the bed rail of FIG. 2 having both of the end rail portions folded inward, adjacent to the central rail portion, and having the support members disengaged from the locking position with the rail member.

The rail member 12 includes a central portion 18 and substantially identical, mirror image end rail portions 20*a,b*. Each end rail portion 20*a,b* is hingedly mounted to the central portion 18 by a respective rail hinge member 24*a,b*. As best seen in FIGS. 1 and 5, the rail hinge members 24*a,b* have parallel axes of rotation, as illustrated at 28 and 30.

The end rails 20*a,b* are rotatable about their respective axes 28, 30 between an open position, as illustrated in FIG. 1, wherein the central rail portion 18 and the end rail portions 20*a,b* are substantially collinear, and a folded position, as illustrated in FIG. 5, wherein the end rail portions 20*a,b* are rotated 180° and are adjacent to the central rail portion 18. When in the open position, the rail member 12 defines a rail plane 32.

The rail member 12 includes a peripheral guard bar 34 and an inner screen-like member 36. The screen-like member 36 prevents a user or a user's extremities (e.g., arms and legs) from passing between the upper and lower portions of the guard bar 34. The screen 36 may include one or more openings therein, such as hand-holds 37, to facilitate handling of the rail 10.

The support members 14*a,b* each include a support leg 38*a,b*. The legs 38*a,b* are hingedly mounted to their respective end rail portions 20*a,b* by support hinge members 42*a,b*. The support hinges 42*a,b* define respective axes 46, 48, which are generally parallel to one another and which may be collinear. The support legs 38*a,b* rotate about their respective axes 46, 48, in a direction which is transverse to the axes of rotation 28, 30 of the end rail portions 20*a,b*. As illustrated, each support leg 38*a,b* includes a toothed or serrated surface 52 to enhance engagement with a mattress M and to retain the rail 10 in place when in use.

Figure 11:
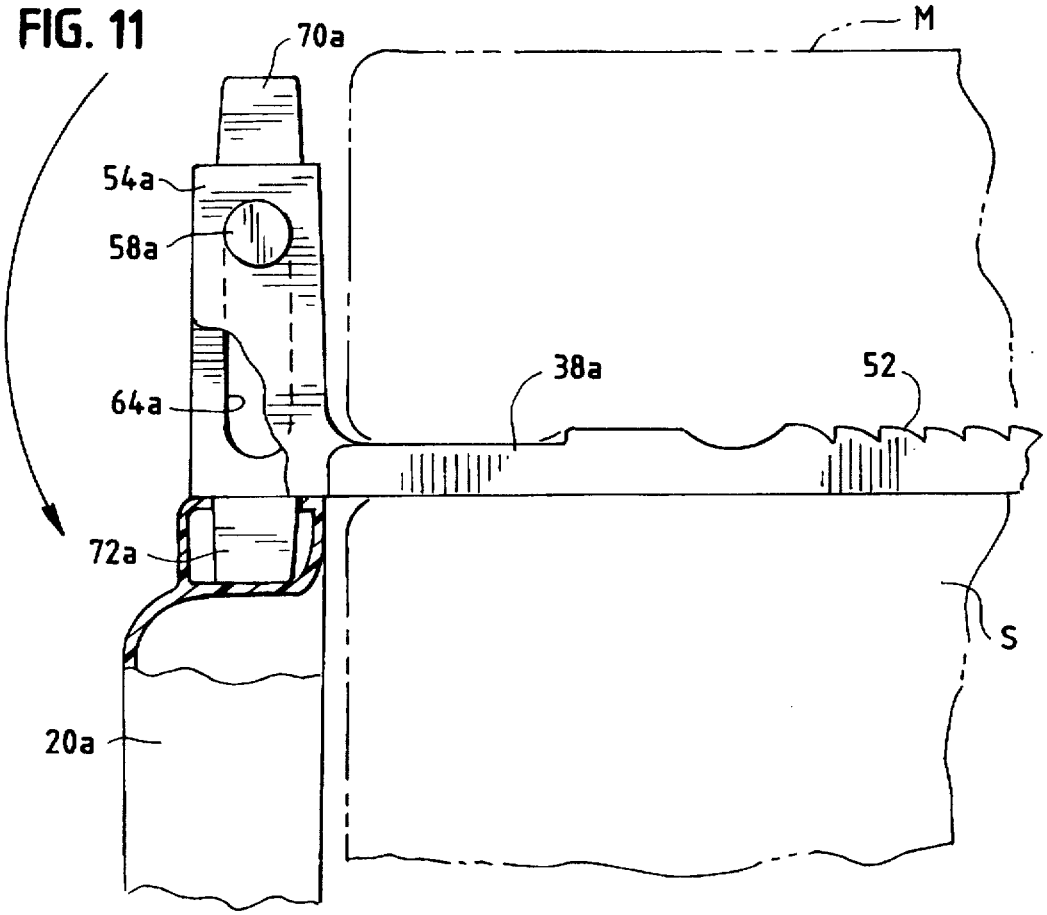
FIG. 11 is a partial, front elevational view similar to FIG. 10, illustrating the support member disengaged from the end rail portion, and showing the rail member, rotated downward to the inoperative position, to provide access to and from the bed, the illustrated parts being those as viewed from the right hand side of the orientation shown in FIG. 2.

The support hinge members 42*a,b* are configured such that the support legs 38*a,b* can rotate at least about 270° about their respective axes 46, 48. This configuration permits the rail member 12 to be positionable in the operative position as illustrated in FIG. 1, and in a downwardly folded position as best seen in FIG. 11. This configuration also permits the support legs 38*a,b* to be folded adjacent to the central rail 18 for storage, as illustrated in FIG. 6

Figure 6:
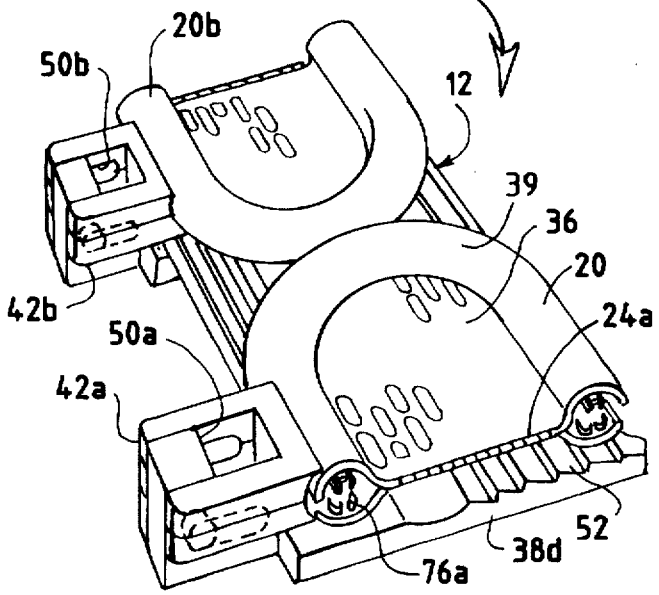
FIG. 6 is a perspective view of the bed rail in the compact, folded state, with the support members folded toward and around the central rail portion.
Figure 10:
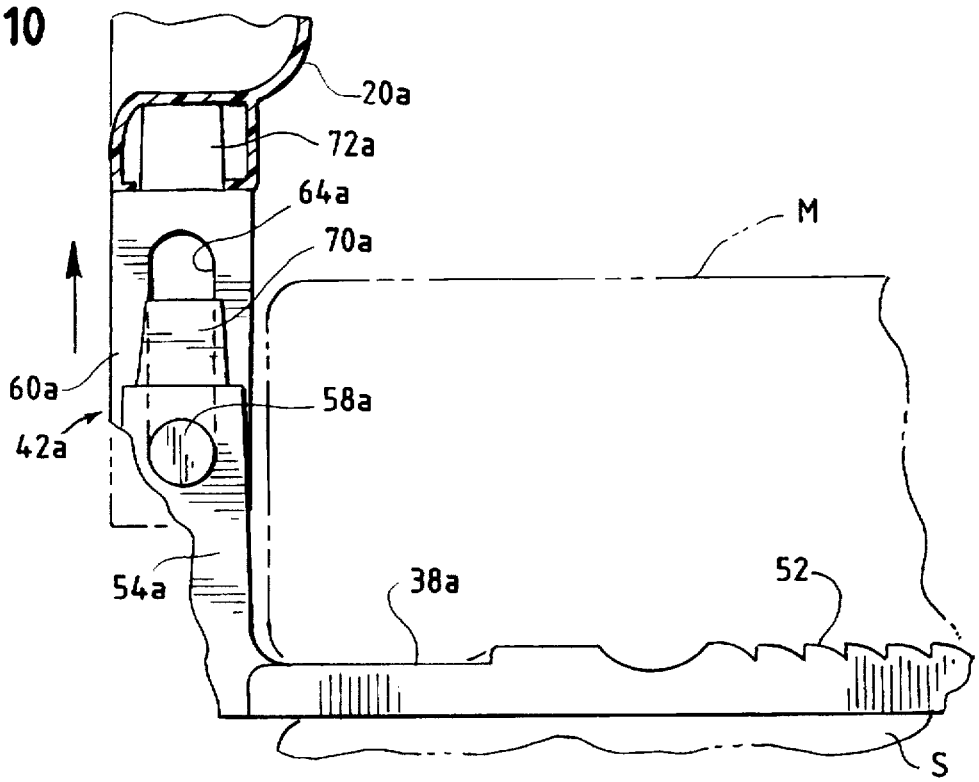
FIG. 10 is a partial, front elevational view of the bed rail with the support member engaged with the end rail portion, locked into the operative position, the illustrated parts being those as viewed from the right hand side of the orientation shown in FIG. 2.

Referring to FIGS. 5–7, to facilitate the rotation of rail member 12 relative to the support members 14*a,b*, the hinge members 42*a,b* each include a slotted, sliding hinge 50*a,b*. The hinges 50*a,b* each include a hinge post 54*a,b* which extends from a respective support member 14*a,b*, generally transverse thereto. Each post 54*a,b* has a pair of hinge pins 58*a,b* which extend from the sides thereof, as illustrated in FIG. 7. The receiving portion 60*a,b* of the hinge 50*a,b* includes a slotted or elongated hinge pin receptacle 64*a,b*.

This arrangement permits rotation of the support members 14*a,b* relative to the rail 12, and also permits transverse movement of (i.e., movement toward and away from) the support member 14*a,b* relative to the rail 12. The transverse movement acts in conjunction with the rotational movement to permit locking the support members 14*a,b* to the rail 12, as discussed herein.

With reference to FIGS. 7–11, the locking feature is implemented by use of a locking portion 66*a,b* in each of the support hinge members 42*a,b*. Each locking portion 66*a,b* is adapted to lock a respective one of the end rail portions 20*a,b* into their respective support members 14*a,b* when in the operative or upright position. The locking portions 66*a,b* each include a tenon-like projection 70*a,b* which extends from the hinge post 54*a,b*, and a mortise-like opening 72*a,b* in the support hinge 42*a,b* which is adapted to receive and engage the tenon 70*a,b*. The slotted receptacles 64*a,b* facilitate the linear movement necessary to engage and disengage the mortise 72*a,b* and tenon 70*a,b* members.

In use, the bed rail 10 is readily set-up or erected into the operative position, and removed from the bed B and folded into the storage position. The set-up and subsequent folding of the bed rail 10 will now be described with reference to FIGS. 1–6.

With the rail 10 in the folded position, as illustrated in FIG. 6, the support members 14*a,b* are first folded downward, into the operative position. In the operative position, the support members 14*a,b* are generally transverse to the rail member 12. The support members 14*a,b* are then locked into the end rail portions 20*a,b* by pressing together the support members 14*a,b* and the end rail portions 20*a,b*. This pushes the tenon-like projections 70*a,b* into engagement with the respective one of the mortise-like openings 72*a,b*.

Figure 2:
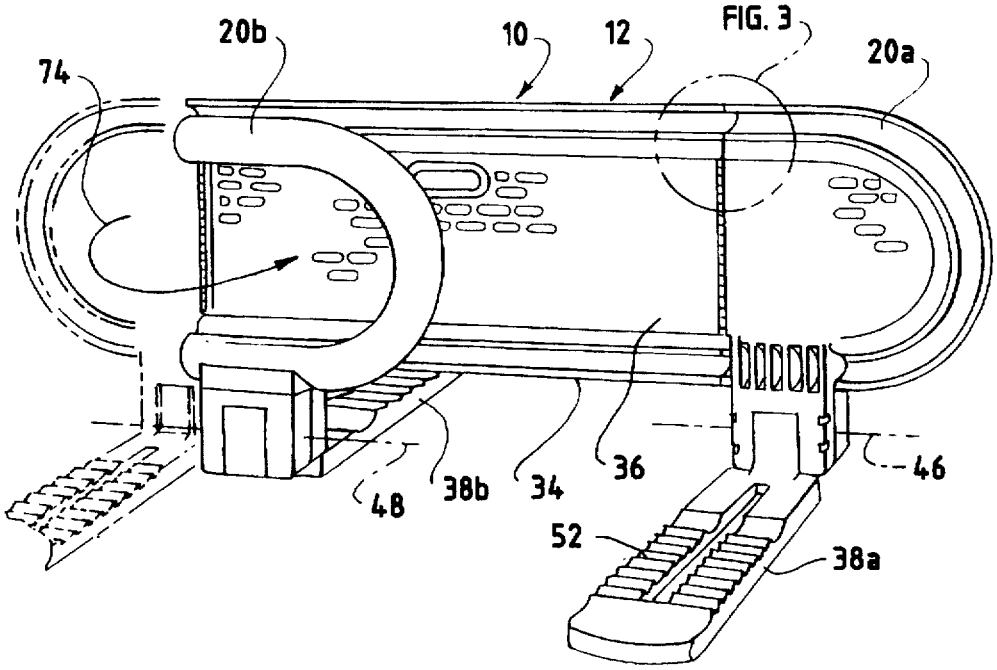
FIG. 2 is a perspective view of the bed rail of FIG. 1, viewed from an opposite side thereof, having one of the end rail portions rotated about its rail hinge and folded toward the central rail portion.

Once the support members 14*a,b* are locked into the transverse position, the end rail portions 20*a,b* are rotated, one at a time, relative to the central rail portion 18. The end rail portions 20*a,b* are rotated, as shown in FIG. 2 (in the direction opposite of arrow 74), until the end rails 20*a,b* extend collinear with the central rail portion 18.

When both of the end rail portions 20*a,b* are fully rotated outwardly to the operative position, as illustrated in FIG. 1, the bed rail 10 can be positioned on a bed B, with the support members 14*a,b* extending between the mattress M and the bed springs or box spring S. It will be recognized by those skilled in the art that the weight of a person on the bed B, above the support legs 38*a,b* assists in retaining the rail 10 in place when in use.

Figure 4:
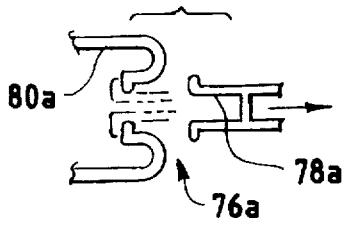
FIG. 4 is a partial elevational view showing the clip member of FIG. 3, the illustrated parts being those as viewed from the right hand side of the orientation shown FIG. 2.
Figure 3:
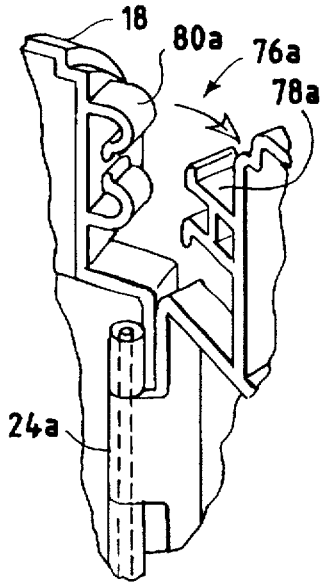
FIG. 3 is a partial perspective view of a joint clip member connecting the central rail portion and an end rail portion, as indicated by the circled region in FIG. 2, the illustrated parts being those as viewed from the right hand side of the orientation shown FIG. 2.

As best seen in FIGS. 3 and 4, the rail member 12 may include rail latches 76*a,b* which latch the end rail portions 20*a,b* to the central rail portion 18. The latches 76*a,b* each include a latch pin 78*a,b* and a receiving portion 80*a,b*. The latch pins 78*a,b* slide into and engage their respective receiving portions 80*a,b* by the rotation of the end rails 20*a,b* relative to and abutting the central rail portion 18.

Advantageously, the rail 12 can be lowered, without removal from the bed B, to provide access to and from the bed B. The rail 12 is first lifted upward, away from the mattress M. This movement unlocks the rail 12 from the support members 14*a,b*. The upward movement disengages the tenon-like projections 70*a,b* from the mortise-like openings 72*a,b*. The rail 12 is then rotated downward, away from the bed B, such that it lies flat against the side of the mattress M as illustrated in FIG. 11. The bed B is then readily accessible, with the rail 12 down.

When it is desired to position the rail 12 in the operative position, the rail 12 is rotated upward to the upright position. It may be necessary to slide the rail 12 upward (by sliding the hinge pins 58*a,b* upward within the slotted receptacles 64*a,b*) to position the rail 12 fully upright. The rail 12 is then urged downward, to engage the mortise 72*a,b* and tenon 70*a,b* members. This movement locks the rail 12 to the support members 14*a,b*, in the operative position.

With reference to FIGS. 2, 5 and 6, to fold the rail 12 into the compact, storage state, the rail 12 is first removed from the bed B. The end rail portions 20*a,b* are rotated inwardly, toward, and adjacent to, the central rail portion 18*a,b*, one at a time, as illustrated in FIG. 2. The rail latches 76*a,b* will readily disengage during rotation of the end rail portions 20*a,b*.

Once the end rail portions 20*a,b* are folded inwardly, the support members 14*a,b* must be disengaged or unlocked. This is accomplished by moving the support members 14*a,b* away from the end rail portions 20*a,b*, until the mortise 72*a,b* and tenon 70*a,b* members fully disengage. The support members 14*a,b* can then be rotated adjacent to the central rail portion 18, as illustrated in FIG. 6, into the folded, compact state.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A compact, foldable bed rail comprising:

a rail member defining a rail plane and having first and second substantially identical, mirror image end rail portions and a central rail portion, each of said end rail portions being hingedly mounted to said central rail portion by respective rail hinge members having parallel axes of rotation, said end rail portions being foldable toward one another and adjacent to said central rail portion;

first and second support members each having a support leg and each being independently hingedly mounted to a respective one of said end rail portions by a support hinge member, said support hinge members having parallel axes of rotation and being rotatable in a direction transverse to said rail hinge members, each of said support hinge members being independently movable toward and away from its respective end rail portion, wherein said support legs are movable between a first, folded position wherein said support legs are foldable adjacent to said rail member, and a second, operative position wherein said support legs are folded away from said rail member, and extend generally transverse to said rail plane.

2. The compact bed rail according to claim 1, wherein said support hinge members each include a locking portion adapted to lockingly engage said support members to said end rail portions when said support legs are in said transverse position.

3. The compact bed rail according to claim 1 wherein each said support hinge member includes a hinge post extending from its respective support member, said hinge post having a pair of hinge pins extending therefrom, and wherein each said end rail portion defines a pair of slotted pin receptacles adapted to engage said hinge pins, wherein said support hinge is configured to permit movement of its respective support leg between said first, folded position and said second, operative position, and wherein said slotted pin receptacle is configured to permit sliding movement of said support member relative to said end rail portion to lockingly engage said support member with its respective end rail portion.

4. The compact bed rail according to claim 3 wherein said hinge post includes a tenon-like projection extending therefrom adapted to engage a mortise-like opening-formed in said support hinge, to lockingly engage said support member with said end rail portion when said support leg is in said second, operative position.

5. The compact, foldable bed rail according to claim 1 wherein said support members are configured to rotate at least about 270° about their respective axes.

6. The compact bed rail according to claim 1 further including a rail latch extending between said central rail portion and said end rail portion to latch said rail portions together when said rail is in said operative position.

7. A compact, foldable bed rail comprising:

a rail member defining a rail plane and having first and second substantially identical end rail portions and a central rail portion, each of said end rail portions being hingedly mounted to said central rail portion by respective rail hinge members having parallel axes of rotation, said end rail portions being foldable toward one another and adjacent to said central rail portion;

first and second support members each having a support leg and each being independently hingedly mounted to a respective one of said end rail portions by a support hinge member, said support hinge members having parallel axes of rotation and being rotatable in a direction transverse to said rail hinge members, each of said support hinge members being independently movable toward and away from its respective end rail portion, wherein said rail is adapted to be folded into a compact, folded state having said end rail portions folded toward one another and adjacent to said central rail portion, and having said support legs folded adjacent to said end rail portions and said central rail portion, with said central rail portion disposed between said end rail portions and said support legs, and wherein said bed rail is adapted to be unfolded into an operative state having said support legs rotated generally transverse to said central rail portion, and generally transverse to and lockingly engaged with said end rail portions, and having said end rail portions rotated about their respective hinge rail hinge portions, relative to said central rail portion, to be substantially coplanar therewith.

8. The compact bed rail according to claim 7 wherein said support hinge members each include a locking portion adapted to lockingly engage said support members to said end rail portions when said support legs are in said transverse position.

9. The compact bed rail according to claim 7 wherein each said support hinge member includes a hinge post extending from its respective support member, said hinge post having a pair of hinge pins extending therefrom, and wherein each said end rail portion defines a pair of slotted pin receptacles adapted to engage said hinge pins, wherein said support hinge is configured to permit movement of its respective support leg between said first, folded position and said second, operative position, and wherein said slotted pin receptacle is configured to permit sliding movement of said support member relative to said end rail portion to lockingly engage said support member with its respective end rail portion.

10. The compact bed rail according to claim 9 wherein said hinge post includes a tenon-like projection extending therefrom adapted to engage a mortise-like opening formed in said support hinge, to lockingly engage said support member with said end rail portion when said support leg is in said second, operative position.

11. The compact bed rail according to claim 7 further including a rail latch extending between said central rail portion and said end rail portion to latch said rail portions together when said rail is in said operative position.

12. The compact, foldable bed rail according to claim 7 wherein said support members are configured to rotate at least about 270° about their respective axes.

13. A foldable bed rail comprising:

a rail member having a central rail portion and a pair of end rail portions, the end rail portions being rotatable adjacent to said central rail portion about first and second generally parallel axes of rotation; and a support member hingedly connected to each said end rail portion, said support members being rotatable about respective axes of rotation generally parallel with one another, and generally perpendicular to said first and second axes of rotation, wherein said support members are adapted to rotate about their respective axes of rotation into a folded position having said central rail portion disposed between said support members and said end rail portions.

14. The foldable bed rail according to claim 13 wherein said rail includes a locking portion adapted to lockingly engage each said support member with its respective end rail portion when said rail is in an operative position.

15. The foldable bed rail according to claim 13 wherein said support members are configured to rotate at least about 270° about their respective axes.

16. A compact, foldable bed rail comprising:

a rail member defining a rail plane;

at least one support member having a support leg, said support member being hingedly mounted to said rail member by a support hinge member, said support hinge member being rotatable in a direction transverse to said rail plane, toward and away from said rail member; and a retaining element extending from said support hinge member adapted to be engageable with said rail member, wherein said support leg is movable between a first, folded position wherein said support leg is foldable adjacent to said rail member, and a second, operative position wherein said support leg is folded away from said rail member, and extends generally transverse to said rail plane, and wherein said retaining element is engageable with said rail member to lock said bed rail into said second operative position.

17. The compact bed rail according to claim 16 wherein said retaining element includes a hinge post having a tenon-like projection extending therefrom, and wherein said rail member defines a mortise-like opening therein adapted to receive said tenon-like projection, and wherein said tenon-like projection and said mortise-like opening are engageable with one another to lock said bed rail into said second operative position.

18. The compact bed rail according to claim 17 wherein said hinge post includes a pair of hinge pins extending therefrom, and wherein said rail member defines a pair of slotted pin receptacles adapted to engage said hinge pins, wherein said support hinge is configured to permit movement of said at least one support leg between said first, folded position and said second, operative position, and wherein said slotted pin receptacle is configured to permit sliding movement of said support member relative to said rail member to lockingly engage said support-member with said rail member.

19. A compact, foldable bed rail comprising:

a rail member defining a rail plane;

at least one support member having a support leg, said support member being hingedly mounted to said rail member by a support hinge member, said support hinge member being rotatable about an axis parallel to said rail plane, toward and away from said rail member; and a retaining element extending from said support hinge member adapted to be engageable with said rail member, wherein said support leg is movable between a first, folded position wherein said support leg is foldable adjacent to said rail member, and a second, operative position wherein said support leg is folded away from said rail member, and extends generally transverse to said rail plane, and wherein said retaining element is engageable with said rail member to lock said bed rail into said second operative position.

20. A portable bed rail usable with an adjacent bed with a mattress comprising:

a panel;

at least one elongated retaining foot; and a molded plastic hinge rotatably and slidably connecting said foot to said panel wherein said hinge supports said panel at a first position, generally perpendicular to said foot, wherein said panel is linearly movable, relative to said foot, to a second position and rotatable to a third position, perpendicular to said foot and parallel to an orientation of said panel when at said first position and wherein for storage, said foot is movable to a fourth position, said fourth position oriented relative to said panel, on the order of about 270° from said first position wherein said foot is generally perpendicular to said panel; to a storage orientation adjacent and substantially parallel to said panel.

21. The portable bed rail according to claim 20 further including a locking portion adapted to lock said hinge in said first position.

22. The portable bed rail according to claim 21 wherein said locking portion includes a tenon-like projection engageable with a mortise-like opening formed in said molded plastic hinge, said mortise-like opening being configured to receive said tenon-like projection to lock said hinge in said first position.

23. The portable bed rail according to claim 20, wherein for storage, said foot is rotatable about an axis arranged along a height of said panel a rotational range of about 180° and thereafter said foot is rotatable about said plastic hinge about 90° to be positioned into said fourth position.

24. A portable bed rail usable with an adjacent bed with a mattress comprising:

a center rail portion;

a first hinge;

an end rail portion connected by said first hinge to said center rail portion;

at least one elongated retaining foot; and a second hinge rotatably and slidably connecting said foot to said end rail portion wherein said second hinge supports said end rail portion at a first position, generally perpendicular to said foot, wherein said end rail portion is linearly movable, relative to said foot, to a second position and rotatable to a third position, perpendicular to said foot and parallel to an orientation of said end rail portion when at said first position, and wherein for storage, said foot is rotatable 180° from said first position about an axis of said first hinge which is perpendicular to said foot and parallel to said panel, and said foot is thereafter rotatable about said hinge 90° toward said end rail portion to a storage orientation adjacent and substantially parallel to said end rail portion.

25. The portable bed rail according to claim 24, comprising:

a further end rail portion, a further elongated retaining foot, and a further first hinge, said further end rail portion connected by said further first hinge to said center rail portion opposite said end rail portion;

a further second hinge rotatably and slidably connecting said further foot to said further end rail portion, wherein said further second hinge supports said further end rail portion at a first position, generally perpendicular to said further foot, wherein said further end rail portion is linearly movable, relative to said further foot, to a second position and rotatable to a third position, perpendicular to said further foot and parallel to an orientation of said further end rail portion when at said first position, and wherein for storage said further foot is rotatable 180° about an axis of said further first hinge perpendicular to said further foot and parallel to said further end rail portion, and thereafter said further foot is rotatable 90° about said further second hinge toward said further end rail portion to a storage orientation adjacent and substantially parallel to said further end rail portion; and in said storage orientation, said foot and said further foot oriented adjacent and substantially parallel to said center portion.

26. The portable bed rail according to claim 25, wherein said second hinge and said further second hinge each include a locking portion adapted to lockingly engage said foot and further foot respectively to said end rail portions when in said first position.

27. The portable bed rail according to claim 26, wherein each said second hinge and further second hinge includes a hinge post extending from its respective foot and further foot, said hinge post having a pair of hinge pins extending therefrom, and wherein each said end rail portion and further end rail portion defines a pair of slotted pin receptacles adapted to engage said hinge pins, wherein said second hinge and said further second hinge is configured to permit movement of its respective foot and further foot between said first position and said third position, and wherein said slotted pin receptacle is configured to permit sliding movement of said foot and further foot relative to said respective end rail portions to lockingly engage said foot and further foot with its respective end rail portion.

28. The portable bed rail according to claim 27, wherein each said hinge post includes a tenon-like projection extending therefrom adapted to engage a mortise-like opening-formed in said second hinge and further second hinge respectively, to lockingly engage said foot and further foot with said end rail portions when said foot and further foot are in said first position.

29. The portable bed rail according to claim 28, further including a rail latch extending between said center rail portion and said end rail portions to latch said center and end rail portions together when said rail is in said operative position.

* * * * *